US006394552B1

(12) United States Patent
Su

(10) Patent No.: US 6,394,552 B1
(45) Date of Patent: May 28, 2002

(54) CHAIR BACKREST WITH AN ADJUSTABLE HEADREST

(76) Inventor: Tung-Hua Su, No. 16, Alley 23, Lane 900, Min Sheng St., Kuei Jen, Tainan Hsien (TW)

( * ) Notice: Subject to any disclaimer, the term of this patent is extended or adjusted under 35 U.S.C. 154(b) by 0 days.

(21) Appl. No.: 09/753,693

(22) Filed: Jan. 4, 2001

(51) Int. Cl.[7] ..... A47C 7/36
(52) U.S. Cl. ..... 297/410
(58) Field of Search ..... 297/410, 391, 297/188.01, 220

(56) References Cited

U.S. PATENT DOCUMENTS 3,205,005 A * 9/1965 Brown
3,429,615 A * 2/1969 Belk
3,449,011 A * 6/1969 Edwards et al.
4,619,483 A * 10/1986 Dickey et al.
5,139,310 A * 8/1992 Itoh
5,277,475 A * 1/1994 Brandes
5,664,840 A * 9/1997 Stenzel

* cited by examiner

*Primary Examiner*—Milton Nelson, Jr.
(74) *Attorney, Agent, or Firm*—Rosenberg, Klein & Lee

(57) ABSTRACT

A vertically moveable headrest (2) is attached to a backrest (1) of a chair which may easily be adjusted in a vertical position to suit user's of differing heights. The backrest (1) includes a pair of upright rods (11) with each upright rod (11) having an annular groove (12). The headrest (2) includes a main body (21) which is configured to provide a support for the user's is head. For adjustment, fasteners (24) are loosened to disengage from the rods (11) and allow vertical movement of the headrest (2) relative to the rods (11) of the backrest (1).

11 Claims, 5 Drawing Sheets

CHAIR BACKREST WITH AN ADJUSTABLE HEADREST

BACKGROUND OF THE INVENTION

1. Field of the Invention

The present invention relates to a chair backrest with an adjustable headrest, and more particularly to a chair backrest having a headrest that is adjustable in a level thereof according to need.

2. Description of the Related Art

Some of the chairs include a headrest on a backrest thereof to support the head of the user. FIG. 5 of the drawings illustrates a conventional backrest 1' whose upper end is fitted with material to form a protruded headrest 2' and covered with a cover 3' to provide an aesthetically pleasing effect. Nevertheless, position of the headrest 2' cannot be adjusted such that the level thereof cannot suit various users of different heights.

SUMMARY OF THE INVENTION

It is the primary object of the present invention to provide a backrest having a headrest that is adjustable in a level thereof so as to suit various users of different heights.

A backrest in accordance with the present invention comprises a headrest mounted thereto, the headrest being adjustable in a vertical direction relative to the backrest. The backrest includes two upright rods on two ends of a top thereof. The headrest includes a main body with two connecting blocks securely attached thereto. Each connecting block includes a vertical hole through which an associated upright rod extends. Each connecting block includes a transverse screw hole that is communicated with the vertical hole. Two fasteners are provided and each extends through the transverse screw hole of an associated connecting block. Each fastener has a distal end in frictional contact with an outer periphery of the associated upright rod. A lid is attached to a rear side of the main body and includes two holes through which the two fasteners extend, respectively. The two holes of the lid are aligned with the transverse screw holes of the connecting blocks. The fasteners are preferably butterfly bolts.

In an embodiment of the invention, the main body includes a compartment in a rear side thereof, the compartment having a lower opening through which the upright rods extend. The lower opening has a width greater than that of the backrest. Each upright rod includes an annular groove in an upper end thereof that extends beyond an associated connecting block. A C-clip is engaged in the annular groove for preventing disengagement of the upright rod from the associated connecting block. A cover is provided for covering the main body and includes an end edge inserted into a groove in the main body.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
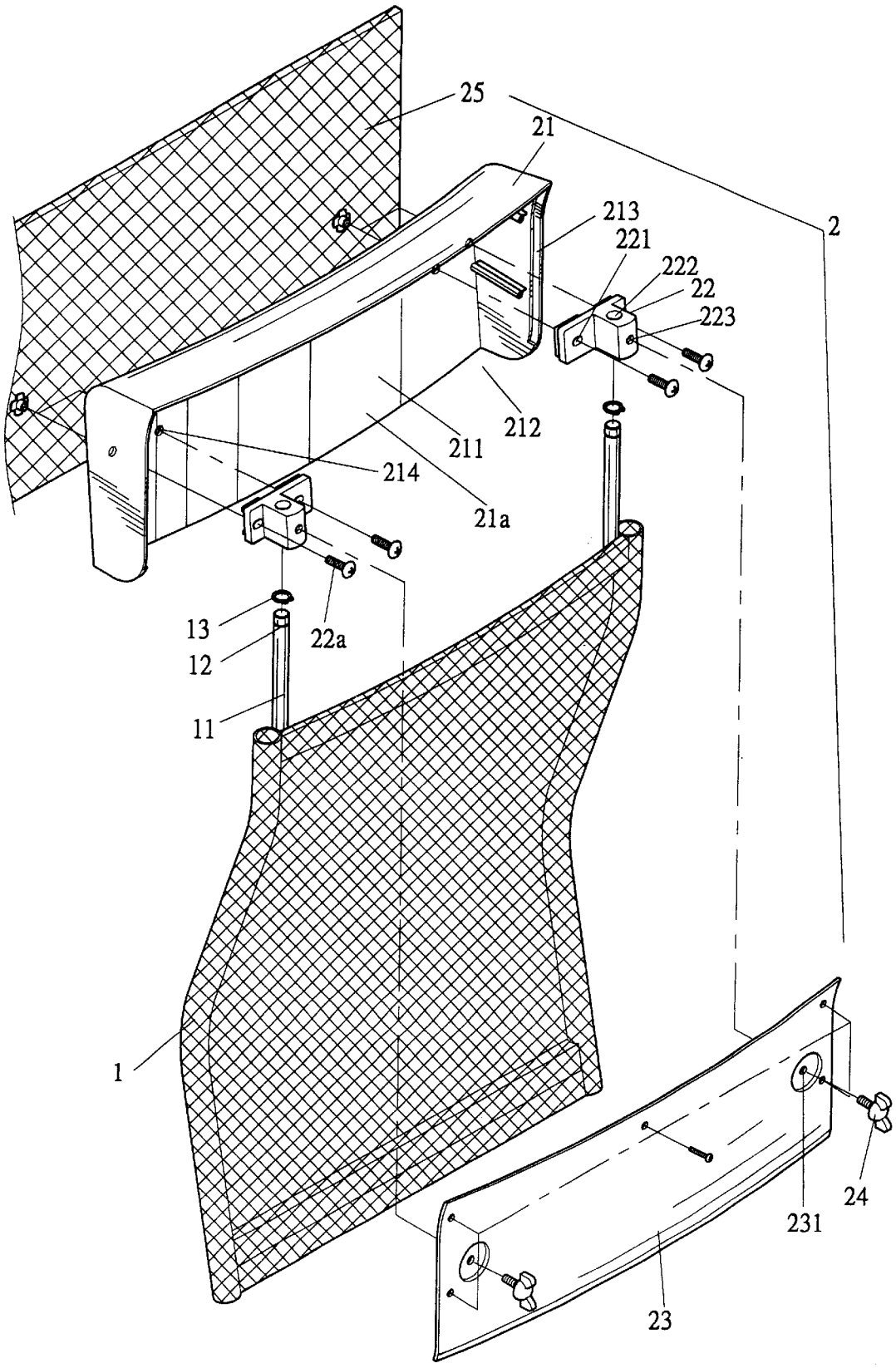
FIG. 1 is an exploded perspective view of a backrest with a headrest in accordance with the present invention.
Figure 2:
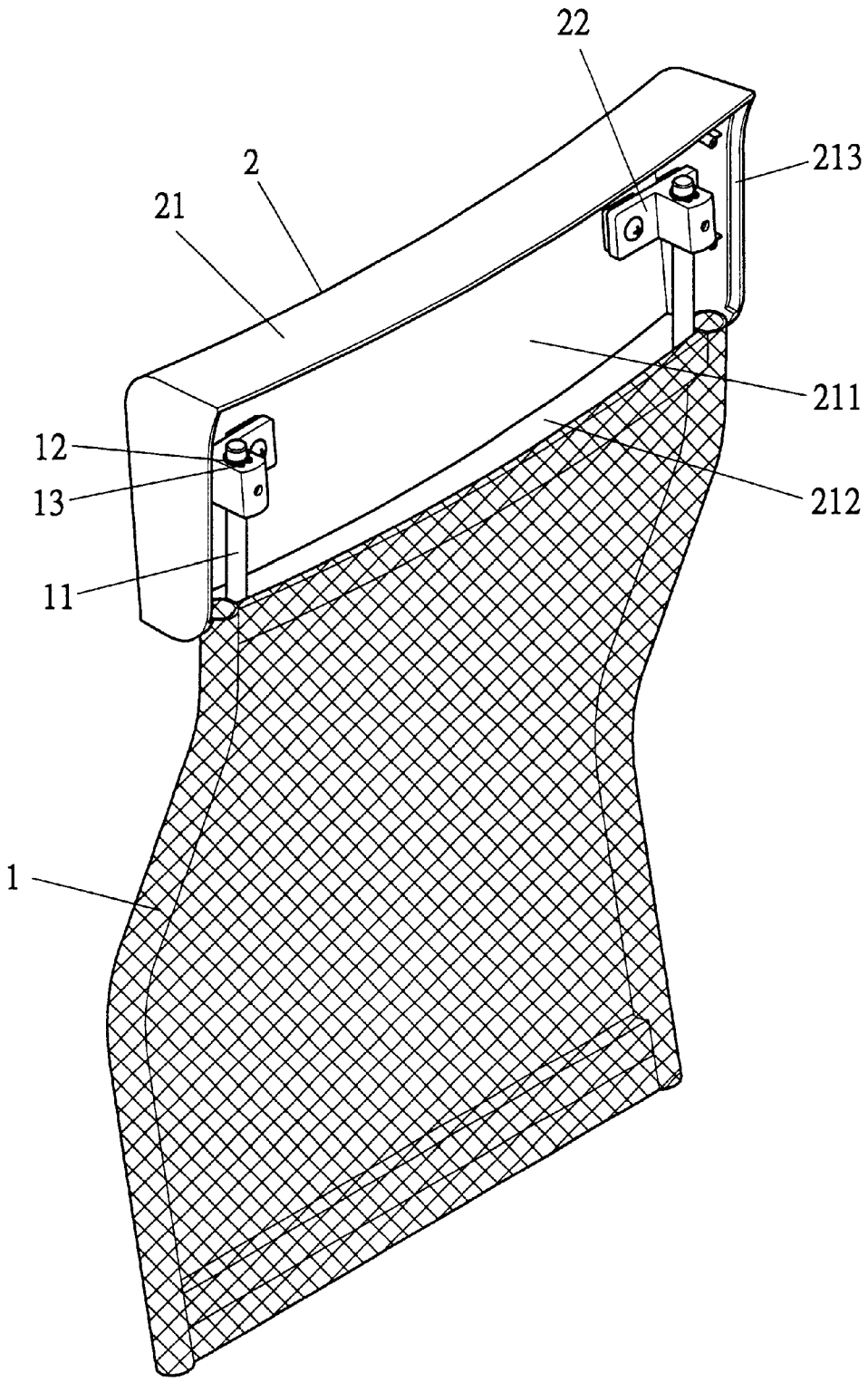
FIG. 2 is a perspective view of the backrest in FIG. 1.
Figure 4:
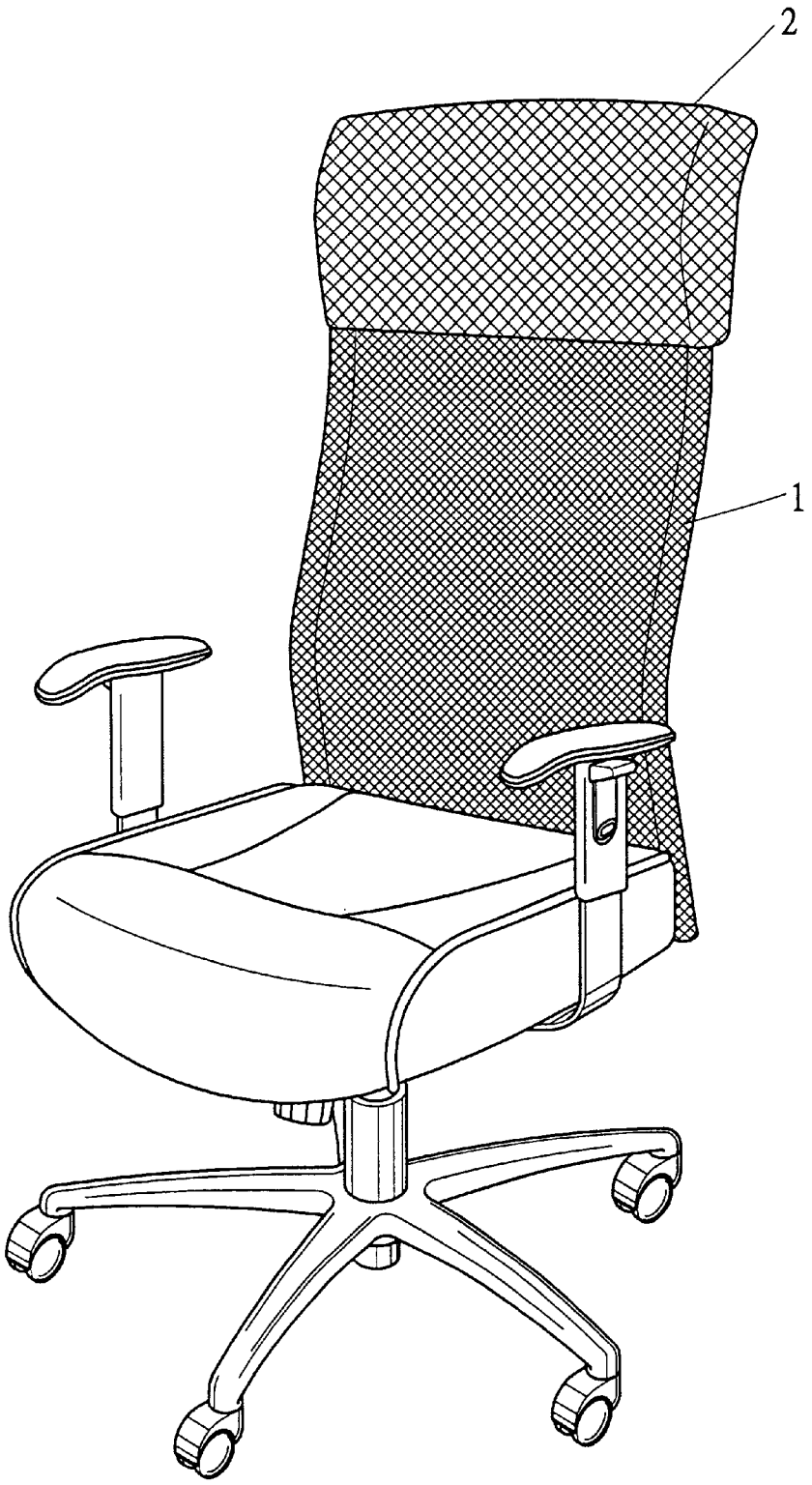
FIG. 4 is a perspective view of a chair equipped with the backrest in accordance with the present invention.
Figure 5:
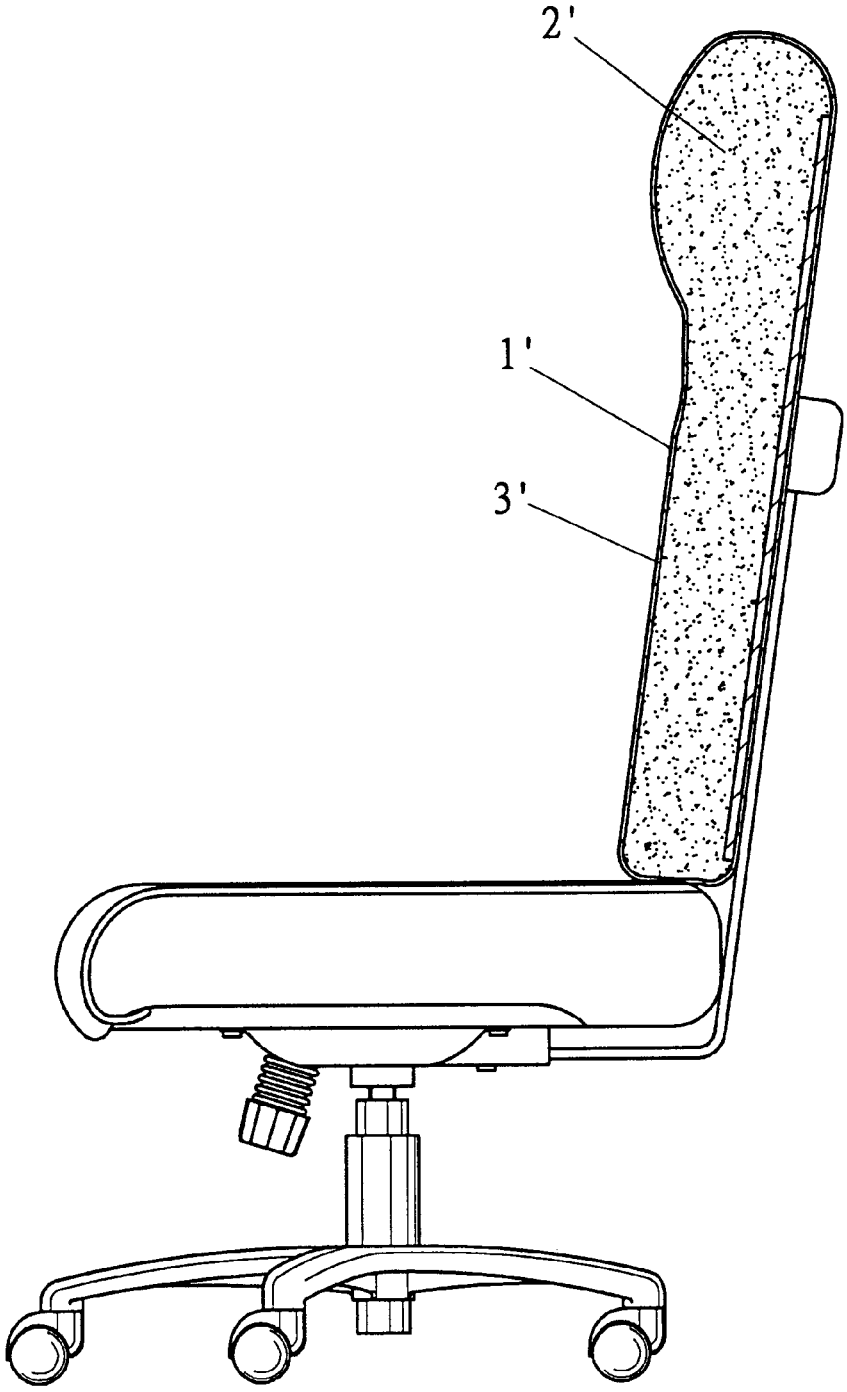
FIG. 5(PRIOR ART)
FIG. 5 is a side view, partly sectioned, of a conventional chair with a headrest.

Referring to FIGS. 1 and 2, the present invention provides a backrest 1 for a chair (FIG. 4), the backrest 1 having an adjustable headrest 2 attached thereto. The backrest 1 includes a pair of upright rods 11 on two ends of a top thereof Each upright rod 11 includes an annular groove 12 in an upper end thereof.

The headrest 2 includes a main body 21, two connecting blocks 22, a lid 23, two fasteners 24, and a cover 25. The main body 21 is configured to provide a support for the user's head and includes having a compartment 211 in a rear side thereof, the compartment 211 having a lower opening 212 with a width greater than that of the backrest 11. The main body 21 further includes a groove 213 into which an end edge of the cover 25 are inserted. The main body 21 further includes a plurality of holes 214 in a front wall 21*a* thereof that defines a bottom of the compartment 211.

Each connecting block 22 is secured to the front wall 21*a* of the main body 21 by means of extending screws 22a through holes 221 in the connecting block 22 and holes 214 of the main body 21. Each connecting block 22 further includes a vertical hole 222 having a diameter slightly greater than an outer diameter of the respective rod 11. Each connecting block 22 further includes a transverse screw hole 223 that is communicated with the vertical hole 222. The lid 23 is attached to the rear side of the main body 21 and includes holes 231 aligned with the screw holes 223 of the connecting blocks 22.

Figure 3:
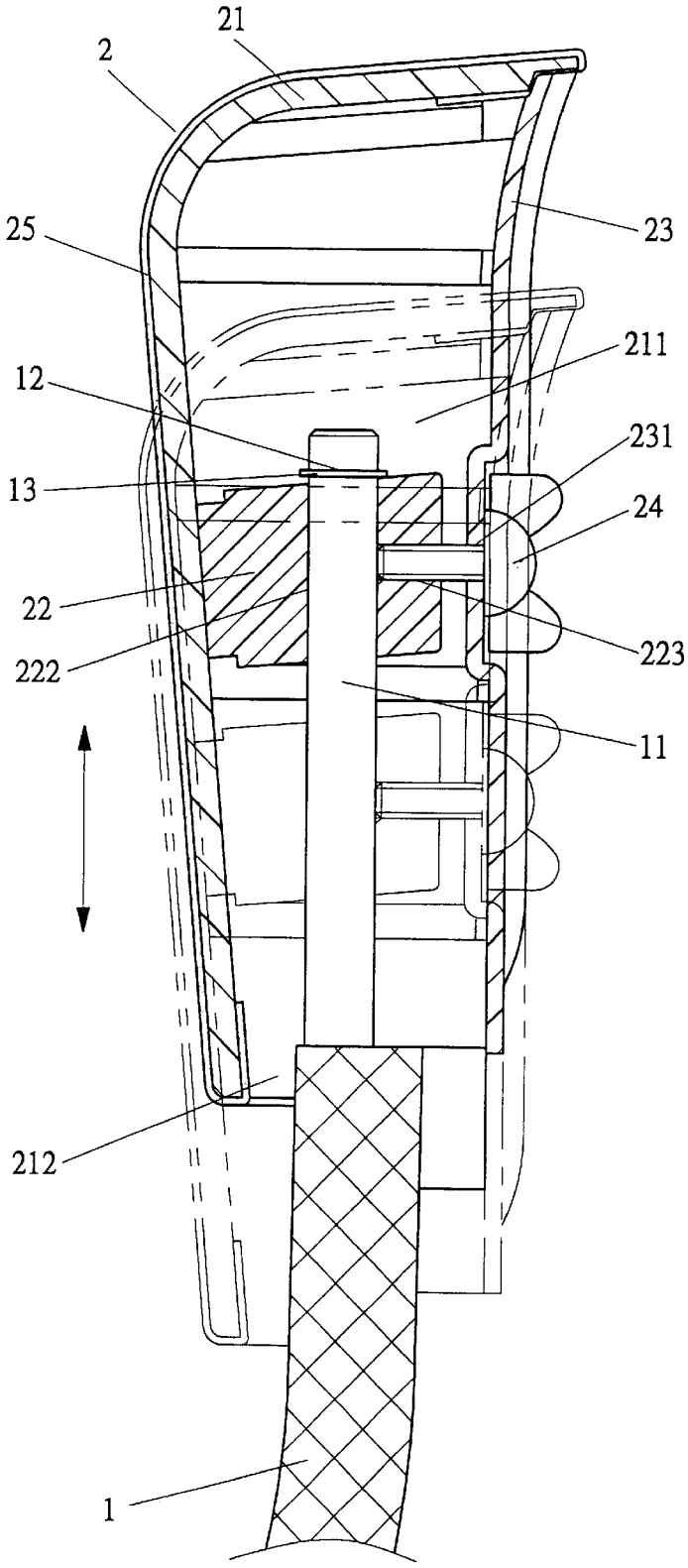
FIG. 3 is an enlarged sectional view of the backrest, illustrating adjustment in the level of the headrest.

In assembly, as illustrated in FIG. 2, each connecting block 22 is securely attached to the front wall 21 of the main body 21 by the screws 22*a* (FIG. 1), and each upright rod 11 of the backrest 1 is extended via the lower opening 212 through the vertical hole 222 of an associated connecting block 22 with a C-clip 13 engaged in the annular groove 12 of the upper end of the respective upright rod 11 that extends beyond the respective connecting block 22. Thus, disengagement of the main body 21 from the backrest 1 is prevented. Next, as illustrated in FIG. 3, the main body 21 is covered by the cover 25 with an end edge of the cover 25 being inserted into the groove 213. Then, the lid 23 is attached to the rear of the main body 21 with the fasteners 24 (such as butterfly bolts) extending through holes 231 in the lid 23 and the transverse screw holes 223 of the connecting blocks 22. It is noted that each fastener 24 includes a distal end that is in frictional contact with an outer periphery of the associated upright rod 11 to thereby retain the headrest 2 on the backrest 1.

Still referring to FIG. 3, when adjustment in the level of the headrest 2 is required, the fasteners 24 are loosened and thus disengaged from the upright rods 11 to allow vertical movement of the whole headrest 2 relative to the upright rods 11 of the backrest 1. When the headrest 2 reaches the desired level, the fasteners 24 are tightened again to thereby retain the headrest 2 in place. It is noted that the lower opening 212 of the compartment 211 of the main body 21 is wider than the backrest 1 such that the upright posts 11 are still hidden in the headrest 2 after the level adjustment.

According to the above description, it. is appreciated that the headrest 2 in accordance with the present invention can be attached to the backrest 1 easily and can be adjusted in the vertical position thereof to suit various users having different heights.

Although the invention has been explained in relation to its preferred embodiment, it is to be understood that many other possible modifications and variations can be made without departing from the scope of the invention as hereinafter claimed.

What is claimed is:

1. A backrest comprising a headrest mounted thereto, the headrest being adjustable in a vertical direction relative to the backrest, the backrest including two upright rods on two ends of a top thereof;

the headrest including a main body with two connecting blocks securely attached thereto, each said connecting block including a vertical hole through which an associated said upright rod extends and a transverse screw hole that is communicated with the vertical hole;

the headrest including two fasteners each extending through the transverse screw hole of an associated said connecting block, each said fastener having a distal end in frictional contact with an outer periphery of the associated upright rod;

the headrest further including a lid attached to a rear side of the main body, the lid including two holes through which the two fasteners extend, respectively.

2. The backrest as claimed in claim 1, wherein the two holes of the lid are aligned with the transverse screw holes of the connecting blocks.

3. The backrest as claimed in claim 1, wherein the fasteners are butterfly bolts.

4. An adjustable seat apparatus comprising:

a backrest having a pair of laterally spaced upright rods extending longitudinally therefrom;

a headrest displaceably coupled to said backrest, said headrest including:

a main body having a laterally extended wall panel portion and an edge portion extending transversely therefrom to define a compartment, said compartment receiving therein at least a portion of said backrest; and, a pair of connecting blocks secured to said main body, each said connecting block being disposed in said compartment and having formed therein a vertical hole slidably receiving therethrough one said upright rod;

a pair of fasteners respectively coupled to said connecting blocks to releasably lock said connecting blocks against displacement relative to said upright rods, each said fastener extending into said vertical hole of at least one said connecting block to frictionally engage at least one said upright rod.

5. The adjustable seat apparatus as recited in claim 4 further comprising a lid coupled to said main body of said headrest to at least partially cover said compartment thereof.

6. The adjustable seat apparatus as recited in claim 4 wherein said main body includes a lower opening communicating with said compartment thereof, said lower opening receiving therethrough said upright rods of said backrest.

7. The adjustable seat apparatus as recited in claim 4 further comprising a cover extending over at least a portion of said wall panel portion of said headrest main body.

8. The adjustable seat apparatus as recited in claim 7 wherein said edge portion of said main body has formed therein at least one groove, said cover having an end edge engaging said groove of said main body edge portion.

9. The adjustable seat apparatus as recited in claim 8 further comprising a lid coupled to said main body of said headrest to at least partially cover said compartment thereof.

10. A backrest comprising a headrest mounted thereto, the headrest being adjustable in a vertical direction relative to the backrest, the backrest including two upright rods on two ends of a top thereof;

the headrest including a main body with two connecting blocks securely attached thereto, each said connecting block including a vertical hole through which an associated said upright rod extends and a transverse screw hole that is communicated with the vertical hole, the main body including a compartment in a rear side thereof, the compartment having a lower opening through which the upright rods extend;

the headrest including two fasteners each extending through the transverse screw hole of an associated said connecting block, each said fastener having a distal end in frictional contact with an outer periphery of the associated upright rod;

each said upright rod of the backrest including an annular groove in an upper end thereof that extends beyond an associated said connecting block, the backrest having a C-clip engaged in the annular groove for preventing disengagement of the upright rod from the associated connecting block.

11. A backrest comprising a headrest mounted thereto, the headrest being adjustable in a vertical direction relative to the backrest, the backrest including two upright rods on two ends of a top thereof;

the headrest including a main body with two connecting blocks securely attached thereto, each said connecting block including a vertical hole through which an associated said upright rod extends and a transverse screw hole that is communicated with the vertical hole, the main body including a compartment in a rear side thereof, the compartment having a lower opening through which the upright rods extend, the lower opening having a width greater than that of the backrest;

the headrest including two fasteners each extending through the transverse screw hole of an associated said connecting block, each said fastener having a distal end in frictional contact with an outer periphery of the associated upright rod.

* * * * *